US009440425B2

(12) United States Patent
Menashe et al.

(10) Patent No.: US 9,440,425 B2
(45) Date of Patent: Sep. 13, 2016

(54) METHODS AND SYSTEMS FOR SETTING THE PRESSURE OF THE CYLINDERS OF THE PRINTING PRESS WITHOUT REQUIRING SPECIAL TARGETS

(71) Applicant: Advanced Vision Technology (AVT) Ltd., Hod Hasharon (IL)

(72) Inventors: Ohad Menashe, Tel-Aviv (IL); Dan Zamir, Hod Hasharon (IL); Shahar Golan, Petah Tikvah (IL)

(73) Assignee: Advanced Vision Technology (AVT) Ltd., Hod Hasharon (IL)

( * ) Notice: Subject to any disclaimer, the term of this patent is extended or adjusted under 35 U.S.C. 154(b) by 0 days.

(21) Appl. No.: 13/886,026

(22) Filed: May 2, 2013

(65) Prior Publication Data

US 2013/0340641 A1 Dec. 26, 2013

Related U.S. Application Data

(60) Provisional application No. 61/641,571, filed on May 2, 2012, provisional application No. 61/817,883, filed on May 1, 2013.

(51) Int. Cl.

| | |
|---|---|
| ***B41F 1/34*** | (2006.01) |
| ***B41F 3/54*** | (2006.01) |
| ***B41F 33/00*** | (2006.01) |
| ***B41F 13/30*** | (2006.01) |
| ***B41F 13/38*** | (2006.01) |

(52) U.S. Cl.

CPC ..... *B41F 3/54* (2013.01); *B41F 13/30* (2013.01); *B41F 13/38* (2013.01); *B41F 33/0036* (2013.01); *B41F 33/0072* (2013.01)

(58) Field of Classification Search

CPC ..... B41F 1/54; B41F 31/32; B41F 31/30; B41F 3/54; B41F 33/0036; B41F 33/0045; B41F 33/0072; B41F 13/30; B41F 13/38

USPC ..... 101/484, 481, 410, 351.3

See application file for complete search history.

(56) References Cited

U.S. PATENT DOCUMENTS

| | | | | |
|---|---|---|---|---|
| 5,448,949 | A | 9/1995 | Bucher | |
| 5,841,955 | A | 11/1998 | Wang | |
| 6,634,297 | B2 | 10/2003 | Poetter et al. | |
| 2001/0032562 | A1 * | 10/2001 | Mayer et al. | 101/484 |
| 2008/0141886 | A1 * | 6/2008 | Whitelaw et al. | 101/484 |

FOREIGN PATENT DOCUMENTS

WO 2013/024186 A1 2/2013

OTHER PUBLICATIONS

Extended European Search Report for European Patent Application No. 13166181.1, mailed Jun. 6, 2016.

* cited by examiner

*Primary Examiner* — Matthew G Marini
(74) *Attorney, Agent, or Firm* — Merchant & Gould P.C.

(57) ABSTRACT

A method for setting the pressure of a printing station includes at least one cylinder, from acquired images of the printed area of the printed web. The method includes displacing the at least one cylinder in accordance with a pre-defined displacement scheme, and acquiring the acquired images of the web throughout the displacement of the at least one cylinder, for each of the at least one cylinder, determining according to the acquired images, a left side print distance and a right side print distance, and determining for the each of the at least one cylinder a left actuator working distance and a right actuator working distance for the left actuator and the right actuator, respectively, according to the left side print distance and according to the right side print distance.

15 Claims, 6 Drawing Sheets

METHODS AND SYSTEMS FOR SETTING THE PRESSURE OF THE CYLINDERS OF THE PRINTING PRESS WITHOUT REQUIRING SPECIAL TARGETS

This application claims benefit of U.S. Provisional Ser. No. 61/641,571, filed 2 May 2012 and U.S. Provisional Ser. No. 61/817,883, filed 1 May 2013 and which applications are incorporated herein by reference. To the extent appropriate, a claim of priority is made to each of the above disclosed applications.

FIELD OF THE DISCLOSED TECHNIQUE

The disclosed technique relates to setting up printing presses in general, and to methods and systems for setting the pressure of the cylinders of the printing press without requiring special targets, in particular.

BACKGROUND OF THE DISCLOSED TECHNIQUE

Systems for setting the pressure of the cylinders of a printing station or a printing press are known in the art. The pressure of the cylinders is set for achieving sufficient print quality, on the one hand, and for reducing ink waste, on the other hand. That is, excessive pressure might increase ink waste and might even deteriorate print quality, for example, by smearing ink. On the other hand, insufficient pressure might lead to lack of ink coverage and an incomplete printed image. Each cylinder is actuated by two actuators (i.e., also referred to as motors or engines) coupled at either end of the cylinder. That is, setting the pressure involves setting the pressure of each of the actuators.

Methods for setting up the pressure of the printing press cylinders are known in the art. In a manual method, the operator runs the printing press, inspects the printed image, and adjusts the pressure between the rollers, until the printed image is acceptable. Automatic set up methods are also known in the art, as detailed herein below.

U.S. Pat. No. 6,634,297 B2 issued to Poetter et al., and entitled "Device and Process for Setting the Printed Image in a Flexographic Press", is directed to a system for setting up a printing job. The desired contour of the image which is to be printed on the paper web is entered into a control and regulating unit. The diameter of the printing roller and the thickness of the blocks are further entered into the control and regulating unit. A camera scans the printed image and feeds the scanned image to the control and regulating unit. The control and regulating unit compares the scanned image with the desired contour, and directs an actuating device to control the servo motors of the cylinders to move the cylinders to a position, which produces the qualitatively best printed image. The values respective of this position are stored in a storage of the control and regulating unit, so that the optimal setting can be found again.

U.S. Pat. No. 5,448,949 issued to Bucher and entitled "Method and Device for Adjusting a Contact Pressure between Ink-Carrying Cylinders of a Printing Machine", is directed to a system for setting up a printing job. During printing, a contact strip is formed on the surface of the printing form. Two opto-electronic sensors sense the contact strip. A control or regulating device determines the width of the contact strip, according to outputs of an angular position sensor and two opto-electronic sensors. The control or regulating device directs an adjusting drives to move the rollers, according to the width of the contact strip, in order to adjust the contact pressure of the rollers.

U.S. Pat. No. 5,841,955 issued to Wang and entitled "Control System For a Printing Press", is directed to a system for adjusting various parameters of a printing press, in real-time, by comparing the variation of ink distribution for each of the cyan, magenta, yellow and black colors, in a current copy, with those in a reference copy.

SUMMARY OF THE PRESENT DISCLOSED TECHNIQUE

It is an object of the disclosed technique to provide a novel method and system for determining the pressure of each cylinder of a printing station in a printing press according to acquired images of the printed area of web In accordance with the disclosed technique, there is thus provided a method for setting the pressure of a printing station of a printing press from acquired images of the printed area of the printed web. The printing station including at least one cylinder. The method includes the procedure of displacing the at least one cylinder of the printing press in accordance with a pre-defined displacement scheme, and acquiring the acquired images of the web throughout the displacement of the at least one cylinder. The method further includes the procedure of determining, for each of the at least one cylinder, according to the acquired images, a left side print distance, at which the printing station prints, at a predetermined sufficient print quality, on the left side of the printed area, and a right side print distance, at which the printing station prints, at a predetermined sufficient print quality, on the right side of the printed area. The method also includes the procedure of determining for the each of the at least one cylinder a left actuator working distance and a right actuator working distance for the left actuator and the right actuator, respectively, of the each of the at least one cylinder, according to the left side print distance and according to the right side print distance.

In accordance with the another aspect of the disclosed technique, there is thus provided a system for setting the pressure of a printing station of a printing press from acquired images of the printed area of the printed web. The printing station includes at least one cylinder. The system includes an imaging device coupled with a processor. The imaging device acquires the acquired images, throughout a displacement of the at least one cylinder according to a pre-defined displacement scheme. The a processor is further coupled with the actuators of each of the at least one cylinder. The processor instructs the actuators of each of the at least one cylinder to perform the pre-defined displacement scheme. The processor receives the acquired images from imaging device and determines a left side print distance, at which the printing station prints, at a predetermined sufficient print quality, on the left side of the printed area, and a right side print distance, at which the printing station prints, at a predetermined sufficient print quality, on the right side of the printed area for each of the at least one cylinder, according to the acquired images.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

The disclosed technique overcomes the disadvantages of the prior art by providing a system and a method for determining the pressure of each cylinder of a printing station in a printing press according to acquired images of the printed area of web. The method involves displacing the cylinders according to a predetermined displacement scheme, while acquiring images of the printed web during the displacement of the cylinders. The method and system according to the disclosed technique allows for deterministic and accurate determination of the pressure of each cylinder.

Each cylinder is actuated by two actuators on either end of the cylinder. The actuators control the position of each cylinder and thereby the pressure each cylinder applies on other cylinders or on the web. Thus, each cylinder is associated with a left actuator distance and a right actuator distance, which are to be determined. A left side print distance indicates the distance of a selected cylinder (i.e., either from the web or from another cylinder, depending on the selected cylinder) at which the printing station prints the left portion of the printed image on the left side of the printed area of the web. According to the disclosed technique, the left side print distance is determined according to the acquired images of the web. A right side print distance indicates the distance of the selected cylinder, at which the printing station prints the right portion of the printed image on the right side of the printed area of the web. The right side print distance is also determined according to the acquired images.

An actuator working distance indicates the distance of the respective actuator of a selected cylinder, at which the printing station prints the image (i.e., both the left and the right sides of the image) at a predetermined sufficient print quality. A left actuator working distance and a right actuator working distance are determined according to the left side print distance, the right side print distance, the width of the cylinder and according to the width of the printed area on the web. It is noted that the terms pressure and distance are interchangeably employed in the following description, as the pressure the cylinder applies on the web or on another cylinder is determined by the distance therebetween.

Figure 1A:
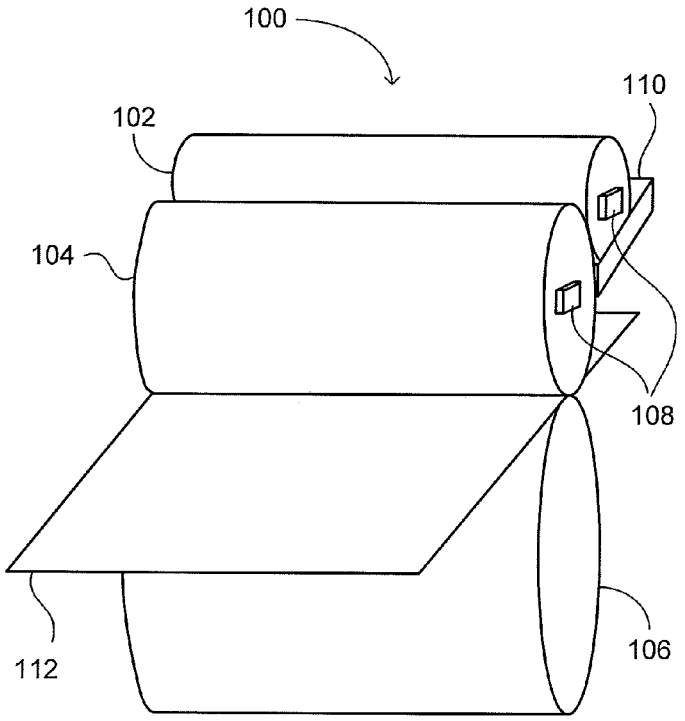
FIG. 1 is a schematic illustration of a printing station, of a printing press, constructed and operative in accordance with an embodiment of the disclosed technique.

Reference is now made to FIG. 1, which is a schematic illustration of a printing station, generally referenced 100, of a printing press, constructed and operative in accordance with an embodiment of the disclosed technique. Printing station 100 is exemplified as a flexographic printing station, which includes an anilox cylinder 102 (also referred to as an anilox roller), a plate cylinder 104 (also referred to as a plate roller), an impression cylinder 106, actuators 108 and an ink basin 110. Printing station 100 prints a printed image (not shown) onto web 112, which runs there through. The area of web 112 on which printing station 100 prints the printed image is defined as a printed area of web 112.

A system (not shown) for setting the pressure of a selected cylinder of printing station 100, includes a camera, or another imaging device, and a processor (both not shown). The camera acquires images of web 112 and in particular of the printed area of web 112. The camera can be either stills or video camera. The processor is coupled with the camera and with actuators 108. The processor receives data from actuators 108 and from the camera, and controls the operation thereof.

During printing, anilox cylinder 102 is in rolling contact with ink basin 110 and with plate cylinder 104. Plate cylinder 104 is in rolling contact with impression cylinder 106. Actuators 108 are coupled with each of anilox cylinder 102 and plate cylinder 104. Anilox cylinder 102 rolls through ink basin 110 and picks up ink therefrom. A printing plate (not shown) is mounted around plate cylinder 104. The printing plate includes a mirror engraving of the image to be printed. Anilox cylinder 102 transfers the ink from the ink basin to the printing plate. The printing plate periodically prints, with each rotation of plate cylinder 104, an image onto web 112, which corresponds to the engraving of the printing plate.

It is noted that left and right sides of each of anilox cylinder 102 and plate cylinder 104 are actuated separately by a respective pair of actuators 108, a left actuator and a right actuator. Generally, actuators 108 control the position of each cylinder and thereby the pressure each cylinder applies on other cylinders or on the web. More specifically, actuators 108 control the relative distance between the plate cylinder and the impression cylinder and between the anilox cylinder and the plate cylinder. Thus, each cylinder is associated with a left actuator working distance and a right actuator working distance, which are to be determined. The working distance of each of actuators 108 is determined such that the printing station prints the image at a predetermined sufficient print quality, and with minimum ink waste.

That is, the ink transfer magnitude ranges between a minimal threshold for the predetermined sufficient print quality, and a maximal threshold for reducing ink waste. In accordance with the disclosed technique, the working distance of each of actuators 108 is determined according to images of the printed area on web 112, as will be described herein below. The images of the printed area are acquired during a series of displacements of the cylinders of printing station 100.

Figure 2A:
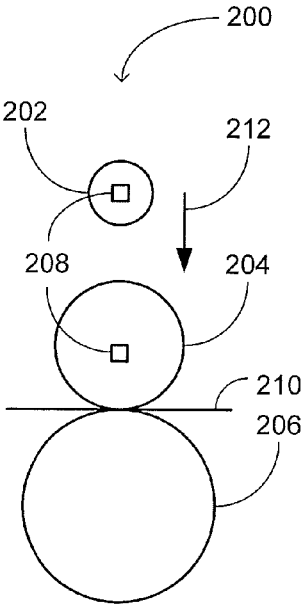
FIGS. 2A-2C are schematic illustrations of a side view perspective of the cylinders of a printing station, during a series of displacements, constructed and operative in accordance with another embodiment of the disclosed technique.
Figure 2B:
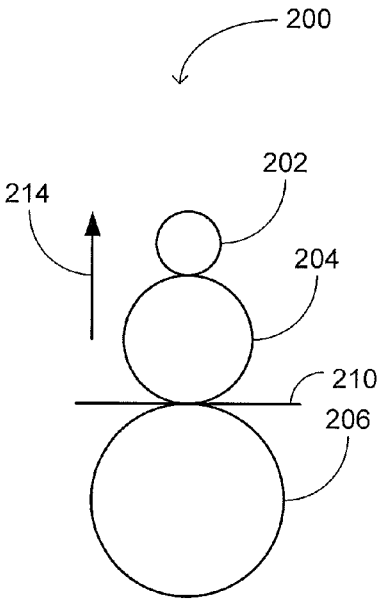
Figure 2C:
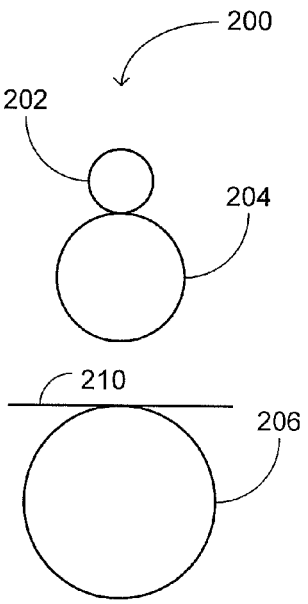

Reference is now made to FIGS. 2A-2C, which are schematic illustrations of a side view perspective of the cylinders of a printing station, generally referenced 200, during a series of displacements, constructed and operative in accordance with another embodiment of the disclosed technique. Printing station 200 includes an anilox cylinder 202, a plate cylinder 204, an impression cylinder 206, and a pair of actuators 208 for each cylinder. Web 210 runs through and is printed on by printing station 200.

In accordance with an aspect of the disclosed technique, FIG. 2A depicts printing station 200 in an initial configuration for setting the relative distance between anilox cylinder 202 and plate cylinder 204, and the relative distance between plate cylinder 204 and web 210. That is, for setting the working distance of the left actuator and of the right actuator of each cylinder. In the initial configuration, plate cylinder 204 is positioned adjacently attached to impression cylinder 206, and anilox cylinder 202 is positioned afar from plate cylinder 204 (i.e., anilox cylinder 202 is completely detached from plate cylinder 204).

Actuators 208 move anilox cylinder 202 toward plate cylinder 204, in the direction of arrow 212, while the camera acquires images of the printed area on web 210. For example, for each unit decrement in the distance, the camera acquires a respective image of the web. As a further example, a video camera acquires a video of the web during the displacements of the cylinders. If correctly set up, the frames of the acquired video are synchronized with the distance values of the actuators of the cylinders, such that each frame corresponds to a respective distance value. It is noted that both the left actuator and the right actuator of anilox cylinder 202 are moving in unison such that the distance between anilox cylinder 202 and plate cylinder 204 changes, but the relative angle between anilox cylinder 202 and plate cylinder 204 does not.

As anilox cylinder 202 moves toward plate cylinder 204 and comes into contact therewith, plate cylinder 204 receives ink from anilox cylinder 202 and prints an image onto web 210 (i.e., onto a printed area of web 210). When anilox cylinder 202 is not in full contact with plate cylinder 204, the printed image may be incomplete (i.e., partial printed image due to partial ink transfer). Actuators 208 move anilox cylinder 202 until it is completely adjacently attached to (i.e., in full contact with) plate cylinder 204, as shown in FIG. 2B. It is noted that for each decrement of a unit distance between the anilox cylinder and the plate cylinder, the camera acquires an image of the web.

After anilox cylinder 202 is adjacently attached to plate cylinder 204, actuators 208 move both anilox cylinder 202 and plate cylinder 204, in unison, away from impression cylinder 206, in the direction of arrow 214. It is noted that both the left actuator and the right actuator of each of anilox cylinder 202 and plate cylinder 204 are moving in unison such that each cylinder maintains its angle relative to web 210 and relative to the other cylinders of printing station 200. As anilox cylinder 202 and plate cylinder 204 move away from web 212, the printed image becomes partial due to insufficient ink transfer from anilox cylinder 202 and plate cylinder 204. When plate cylinder 204 is fully detached from (i.e., loses all contact with) web 210, as shown in FIG. 2C, printing station 200 stops printing the printed image on web 210. It is noted that for each increment of a unit distance between the plate cylinder and the web, the camera acquires an image of the web.

Figures 2D, 2E, 2F:
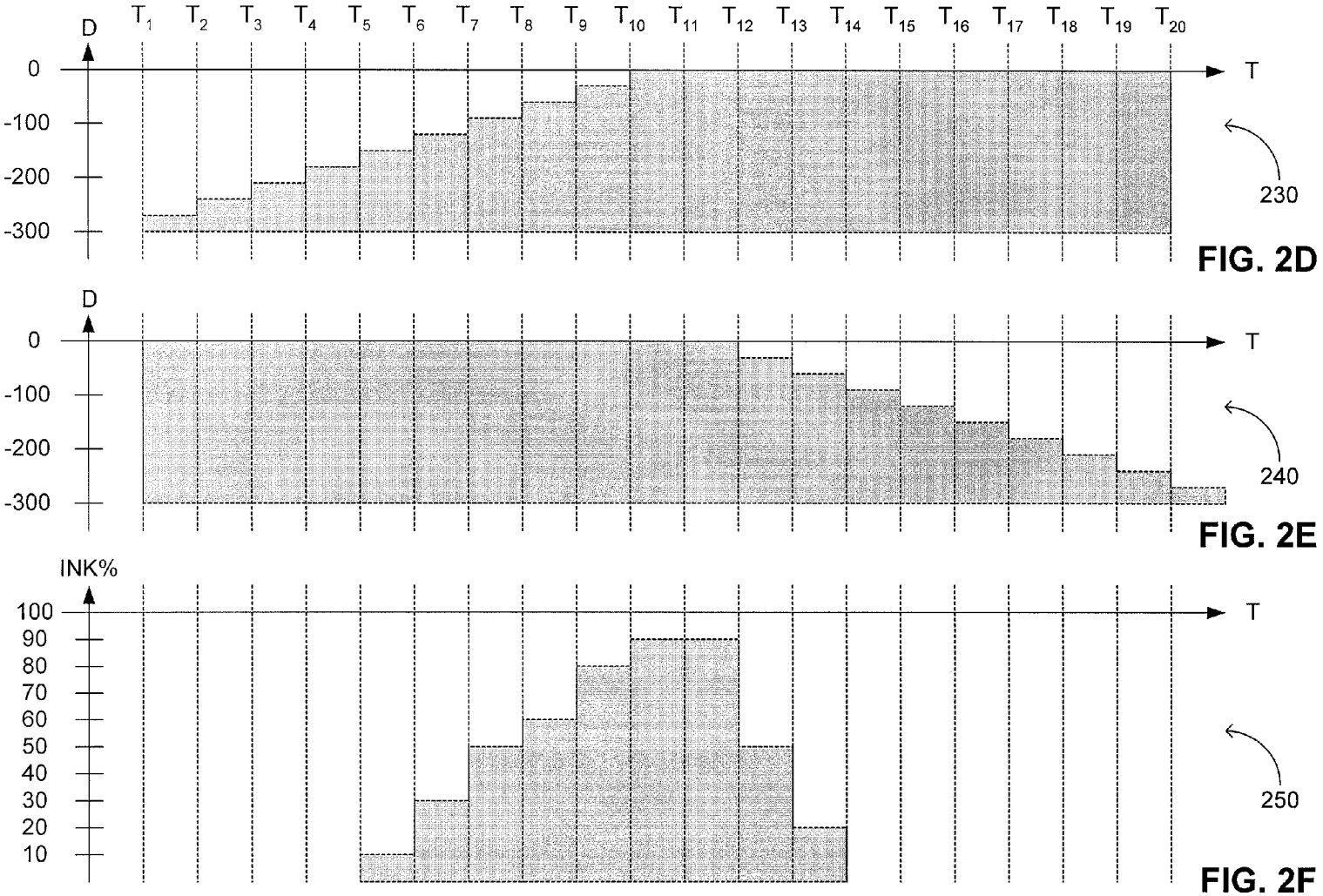
FIG. 2D is a schematic illustration of an anilox distance graph, presenting the distance between the anilox cylinder and the plate cylinder versus the time, constructed in accordance with a further embodiment of the disclosed technique.
FIG. 2E is a schematic illustration of a plate distance graph, presenting the distance between the plate cylinder and the impression cylinder versus the time, constructed In accordance with another embodiment of the disclosed technique.
FIG. 2F is a schematic illustration of an ink transfer graph, presenting the ink transfer percentage onto a selected vertical segment of the printed area on the web versus the time, constructed and operative in accordance with a further embodiment of the disclosed technique.

Reference is now made to FIG. 2D, which is a schematic illustration of an anilox distance graph, generally referenced 230, presenting the distance between the anilox cylinder and the plate cylinder (e.g., anilox cylinder 202 and plate cylinder 204 of FIGS. 2A-2C) versus the time, constructed in accordance with a further embodiment of the disclosed technique. The vertical axis of anilox distance graph 230 presents the distance from the anilox cylinder to the plate cylinder. The furthest distance between the anilox cylinder and the plate cylinder presented by anilox distance graph 230 is (−)300 [micrometer—μm], and the closest distance is 0 [μm]. The horizontal axis of anilox distance graph 230 presents the time of each measurement of the distance between the anilox cylinder and the plate cylinder. In the examples set forth in FIGS. 2D-2F, the distances are indicated in negative values. Alternatively, the distances may be presented in positive values mutatis mutandis.

Anilox distance graph 230 presents the displacements of the anilox cylinder as performed by actuators 208 (FIGS. 2A-2C). In particular, as detailed herein above with reference to FIG. 2A, actuators 208 move (i.e., displace) anilox cylinder 202 toward plate cylinder 204 until it is adjacently attached to plate cylinder 204.

Reference is now made to FIG. 2E, which is a schematic illustration of a plate distance graph, generally referenced 240, presenting the distance between the plate cylinder and the impression cylinder (e.g., plate cylinder 204 and impression cylinder 206 of FIGS. 2A-2C) versus the time, constructed In accordance with another embodiment of the disclosed technique. The vertical axis of plate distance graph 240 presents the distance from the plate cylinder to the impression cylinder. The horizontal axis of plate distance graph 240 presents the time of each measurement of the distance between the plate cylinder and the impression cylinder.

Plate distance graph 240 presents the displacements of the plate cylinder as performed by actuators 208 (FIGS. 2A-2C). In particular, as detailed herein above with reference to FIG. 2B, actuators 208 move (i.e., displace) both plate cylinder 204 and anilox cylinder 202, in unison, away from impression cylinder 206 until plate cylinder is positioned afar from impression cylinder 206.

Reference is now made to FIG. 2F, which is a schematic illustration of an ink transfer graph, generally referenced 250, presenting the ink transfer percentage onto the printed area on the web versus the time, constructed and operative in accordance with a further embodiment of the disclosed technique. The vertical axis of ink transfer graph 250 presents the percentage of ink transfer from the plate cylinder onto the printed area. The horizontal axis of ink transfer graph 250 presents the time of each ink transfer percentage measurement.

As detailed herein above in FIGS. 2A-2C, and as can be seen from graphs 230, 240 and 250, at the initial configuration (i.e., t=0), the anilox cylinder is positioned afar from the plate cylinder and no ink is transferred to the web. As the anilox cylinder approaches the plate cylinder, the plate cylinder begins receiving ink from the anilox cylinder and transferring the ink onto the web. When the anilox cylinder is adjacently attached to the plate cylinder the ink transfer percentage is at its highest level. Afterwards, as both the plate cylinder and the anilox cylinder begin getting away from the impression cylinder and the web, ink transfer percentage drops until no ink is transferred at all.

Ink transfer percentage is determined according to the acquired images of the web, during the displacements of the anilox cylinder and of the plate cylinder. The ink transfer percentage is determined by comparing the magnitude of ink transfer onto an image (i.e., or a selected segment of the image) with the magnitude of ink transfer onto a reference image. The reference image is produced, for example, by printing the printed image when the anilox cylinder is adjacently attached to the plate cylinder, which in turn is adjacently attached to the impression cylinder.

The magnitude of ink transfer is determined by determining the location in a color space, of each pixel of an acquired image of the printed area. Then, the distance of each pixel, in the color space, from a background reference pixel is determined. The background reference pixel is a pixel from an image of a portion of the web, which is not printed on. The magnitude of ink transfer onto the printed area (i.e., or a selected segment thereof) is the sum of the distances, in the color space, of each of the pixels in the printed area from the background reference pixel. Color space can be, for example, RGB, CMYK, HSV, or LAB.

Alternatively, the coordinates of the pixels are determined in more that one color space and the distances in each color space from the reference pixel location are averaged.

In the example set forth in FIG. 2F, ink transfer graph 250 depicts the ink transfer percentage as a function of the time. Alternatively, an ink transfer graph can depict the ink transfer percentage as a function of the distance between cylinders. For example, according to graphs 230 FIG. 2D, the distance between the anilox cylinder and the plate cylinder is depicted as a function of the time. Thus, the time in the ink transfer graph can be replaced by the distance between the anilox cylinder and the plate cylinder, according to graph 230. In a similar manner, the time can be replaced by the distance between the plate cylinder and the impression cylinder according to graph 240.

As mentioned above, the camera continuously acquires images of the printed area of web 210 throughout the displacements of anilox cylinder 202 and of plate cylinder 204. These images are analyzed for determining a left side print distance and a right side print distance, for a selected one of the cylinders (e.g., anilox cylinder 202 or plate cylinder 204), as described herein below with reference to FIGS. 3A-3B, 4A-4C and 5. The left side print distance is the relative distance of the selected cylinder, at which the printing station prints the left side of the printed image onto the left side of the printed area. Similarly, the right side print distance is the relative distance of the selected cylinder, at which the printing station prints the right side of the printed image onto the right side of the printed area.

Figure 3A:
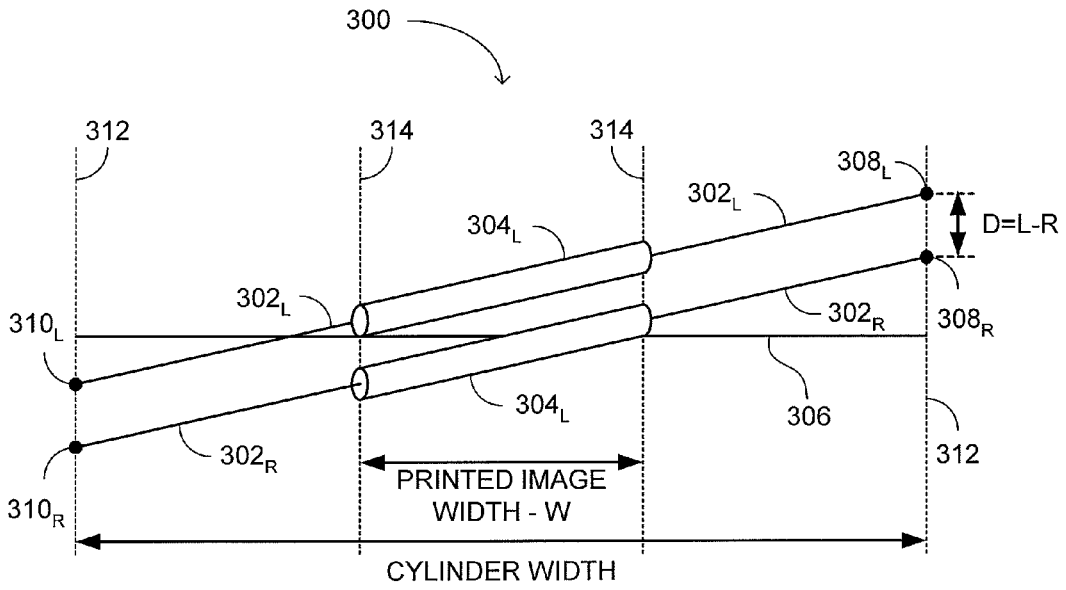
FIGS. 3A and 3B are schematic illustrations of a cylinder geometric configuration, generally referenced 300, presenting the geometric configuration of a selected cylinder with respect to the web, constructed and operative in accordance with another embodiment of the disclosed technique.
Figure 3B:
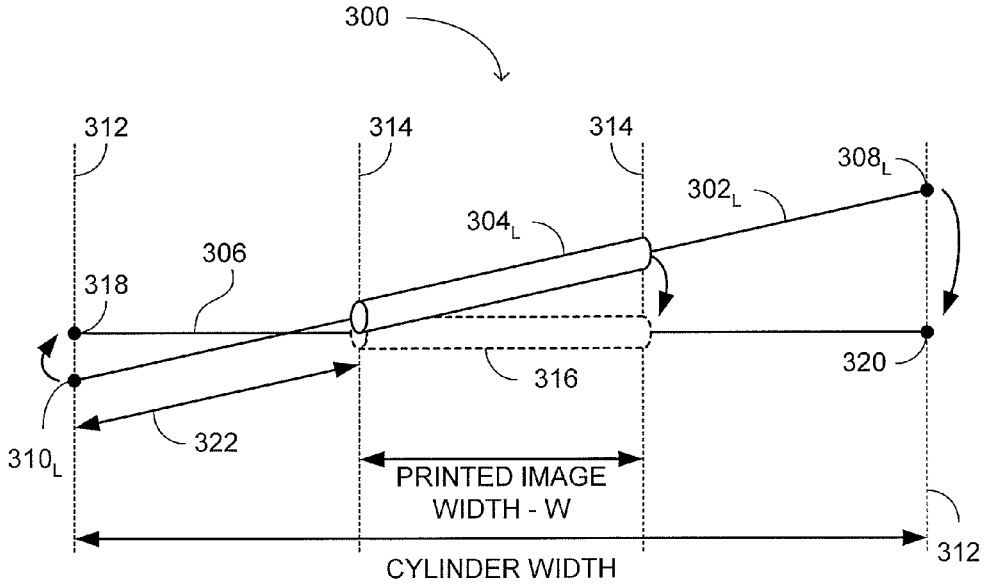

The left side print distance and the right side print distance are employed for determining a left actuator working distance and a right actuator working distance for the left actuator and the right actuator, respectively, of the selected cylinder. The left and the right actuator working distances are the distance values of the left and the right actuators, respectively, of the selected cylinder, at which the printing station prints the entire printed image on the printed area, at a predetermined sufficient print quality. Reference is now made to FIGS. 3A and 3B, which are schematic illustrations of a cylinder geometric configuration, generally referenced 300, presenting the geometric configuration of a selected cylinder with respect to the web, constructed and operative in accordance with another embodiment of the disclosed technique. Cylinder geometric configuration 300 is employed for determining a left actuator working distance 318 and a right actuator working distance 320 (FIG. 3B) for the selected cylinder. In the example set forth in FIGS. 3A and 3B, the selected cylinder is the plate cylinder (e.g., plate cylinder 104 of FIG. 1 or plate cylinder 204 of FIGS. 2A-2C).

With reference to FIG. 3A, cylinder geometric configuration 300 presents the selected cylinder in two positions, each corresponding to a different relative distance from the web or from another cylinder. Cylinder $\mathbf{302}_L$ represents the selected cylinder when positioned at left side print distance L from the web, and cylinder $\mathbf{302}_R$ represents the selected cylinder when positioned at right side print distance R from the web. The selected cylinder includes a printing plate mounted thereon. In the example set forth in FIG. 3A, cylinder $\mathbf{302}_L$ includes a printing plate $\mathbf{304}_L$ mounted thereon, cylinder $\mathbf{302}_R$ includes a printing plate $\mathbf{304}_R$ mounted thereon.

Cylinder geometric configuration 300 further presents a web 306. As mentioned above, in the example set forth in FIGS. 3A and 3B, cylinder geometric configuration 300 is employed for setting the distance of the plate cylinder from the web. Alternatively, when determining the distance of the anilox cylinder from the plate cylinder, web 306 is replaced with a plate cylinder 306.

Left side print distance L marks the distance of the cylinder at which the printing station prints the printed image on the left side of the printed area, which is defined by dotted lines 314. Thus, cylinder $\mathbf{302}_L$ is depicted as touching the left end of the printed area of web 306. To avoid confusion, it is noted that cylinder $\mathbf{302}_L$ presents the selected cylinder entirely, and not just a portion thereof, when positioned such that printing station prints the left side of the printed image on the printed area. For distances substantially below L, the printed image on the left side of the printed area might lack sufficient ink transfer, and for distances substantially above L, ink transfer might be excessive, thereby wasting ink, or even affecting the printed image quality.

In a similar manner, right side print distance R marks the distance of the cylinder at which the printing station prints the printed image on the right side of the printed area. Thus, cylinder $\mathbf{302}_R$ is depicted as touching the right end of the printed area of web 306. Note that cylinder $\mathbf{302}_R$ is applying larger pressure on the left side of the printed area due to the angle of cylinder $\mathbf{302}_R$ with respect to web 306.

It is noted that the determined side print distances L and R can be measured at each of the opposite ends of the cylinder, defined by dotted lines 312, according to acquired images of the printed area. As mentioned above with reference to FIGS. 1 and 2A-2C, each cylinder is displaced by moving both respective actuators in unison such that only the distance of the cylinder from the web or from another cylinder changes while the relative angle of the cylinder does not change. Therefore, cylinder $\mathbf{302}_L$ positioned at left side print distance L, is associated with a left side print actuator distance $\mathbf{310}_L$ and a right side print actuator distance $\mathbf{308}_L$.

The angle of the respective cylinder with respect to web 306 is defined by the difference D between left side print distance L and right side print distance R. That is, difference D corresponds to the difference between left side print actuator distance $\mathbf{310}_L$ and right side print actuator distance $\mathbf{308}_L$ associated with side print distance L and with cylinder $\mathbf{302}_L$. The difference D further corresponds to the difference between left side print actuator distance $\mathbf{310}_R$ and right side print actuator distance $308_R$ associated with side print distance R and with cylinder $302_R$.

With reference to FIG. 3B, cylinder geometric configuration 300 is employed for determining left actuator working distance 318 and right actuator working distance 320, at which the selected cylinder uniformly transfers ink to the printed area of web 306, as represented by cylinder 316. Each of left actuator working distance 318 and right actuator working distance 320 are geometrically derived from either left side print actuator distance $310_L$ and right side print actuator distance $308_L$ or from left side print actuator distance $310_R$ and right side print actuator distance $308_R$, as detailed herein.

The width of the printed area, W, is approximately similar to the width of the printing plate (either printing plate $304_L$ or printing plate $304_R$). Therefore, the width of the printing plate is considered as having the same width W for the sake of determining the actuator working distances. A length denoted by 322 is the length of cylinder $302_L$ extending beyond the left end of the printed area. As printing plate $304_L$ is positioned substantially at the center of cylinder $302_L$, length 322 further corresponds to the length of cylinder $302_L$ extending beyond the right end of the printed area.

Left actuator working distance 318 is defined by either of equations (1) or (2):

$$(\text{Left actuator working distance 318})=(\text{left side print actuator distance } 310_L)-(\text{length 322})*\text{Sin}(\alpha) \quad (1)$$

$$(\text{Left actuator working distance 318})=(\text{left side print actuator distance } 310_R)-[(\text{length 322})+W]*\text{Sin}(\alpha) \quad (2)$$

Wherein $\alpha$ being the inclination angle of cylinder $302_L$ with respect to web 306, and wherein Sin($\alpha$) is given by (D/W).

Right actuator working distance 320 is defined by either of equations (3) or (4):

$$(\text{Right actuator working distance 320})=(\text{Right side print actuator distance } 308L)+[(\text{length 322})+W]*\text{Sin}(\alpha) \quad (3)$$

$$(\text{Right actuator working distance 320})=(\text{Right side print actuator distance } 308R)+(\text{length 322})*\text{Sin}(\alpha) \quad (4)$$

Wherein $\alpha$ being the inclination angle of cylinder $302_R$ with respect to web 306, and wherein Sin($\alpha$) is given by (D/W). Left actuator working distance 318 and right actuator working distance 320 are set as the distance values of the left actuator and of the right actuator, respectively, of the selected cylinder.

As mentioned above, the left side print distance L and the right side print distance R are employed for setting the distance values of the selected cylinder (i.e., of the actuators of the selected cylinder). Left side print distance L and the right side print distance R are determined according to the acquired images of the printed area (e.g., acquired by the camera, as detailed herein above with reference to FIG. 1). The acquired images are analyzed for producing a set of ink transfer graphs, as detailed herein above with reference to FIGS. 2D-2F. Each of the set of ink transfer graphs presents the ink transfer to a respective vertical segment of the printed area versus the time. The ink transfer graphs are employed for determining a distance-to-print line, which in turn is employed for determining left side print distance L and the right side print distance R, as detailed herein below with reference to FIG. 4A-4C.

The set of ink transfer graphs is analyzed and a low transfer distance and a high transfer distance are determined for the selected cylinder. A low transfer distance is the distance of the selected cylinder (e.g., the distance of the anilox cylinder from the plate cylinder or the distance of the plate cylinder from the impression cylinder) at which ink transfer percentage is low, such as 10%. In particular, the low transfer distance for the anilox cylinder is the distance of the anilox cylinder from the plate cylinder at which ink transfer percentage is 10%, during the displacement of the anilox cylinder toward the plate cylinder, as detailed herein above with reference to FIG. 2A. The low transfer distance for the plate cylinder is the distance of the plate cylinder from the impression cylinder at which ink transfer percentage is 10%, during the displacement of both the plate cylinder and the anilox cylinder, in unison, away from the impression cylinder, as detailed herein above with reference to FIG. 2B. A high transfer distance is the distance of the selected cylinder at which ink transfer percentage is high, such as 90%. Similarly as in the case of low transfer, the high transfer distance can be found for both the anilox cylinder and the plate cylinder.

Alternatively, each of the low transfer distance and the high transfer distance can be associated with other values of ink transfer. For example, the low transfer distance can be associated with ink transfer of 20%, and the high transfer distance can be associated with ink transfer of 85%. Further alternatively, each of the low transfer distance and the high transfer distance can be replaced with other distances indicating low ink transfer and high ink transfer. For example, the high ink transfer distance can be replaced with a Single Defect distance, which is the distance of the selected cylinder at which the printed image exhibits only a single print defect.

Figure 4A:
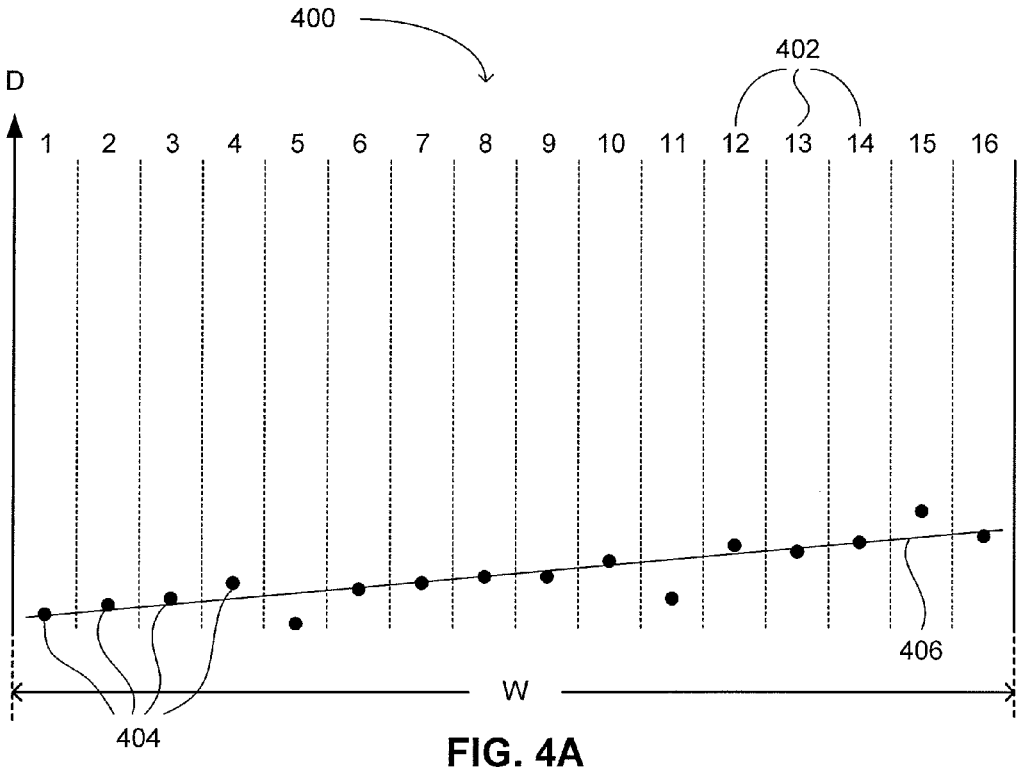
FIG. 4A is a schematic illustration of a printed area, including a set of low transfer distance points, constructed in accordance with a further embodiment of the disclosed technique.

Reference is now made to FIG. 4A, which is a schematic illustration of a printed area, generally referenced 400, including a set of low transfer distance points, constructed in accordance with a further embodiment of the disclosed technique. Printed area 400, having a width W, is divided into a selected number of vertical segments 402. Each vertical segment 402 includes a low transfer distance point 404 corresponding to a low transfer distance as determined by the respective ink transfer graph (e.g., ink transfer graph 250 of FIG. 2F). In the example set forth in FIGS. 4A-4C, the selected number of vertical segments is 16. Alternatively, printed area 400 can be divided into any number of vertical segments 402, from 2 and up to the number of pixels in the imaging device.

A curve is fitted to at least a portion of the set of low distance transfer points 404 for determining the left side print distance L and the right side print distance R. In the example set forth in FIG. 4A, the curve is a straight line 406. Straight line 406 is fitted to the set of low distance transfer points 404 by, for example, linear regression or another line fitting method. The angle (i.e., inclination or slope) of straight line 406 is determined and is employed for determining a printing distance line, as detailed herein below with reference to FIG. 4C.

It is reminded that the low transfer distances, and printed area 400, including low transfer distance points 404, are associated with a selected cylinder (e.g., the distance of the anilox cylinder from the plate cylinder, or the distance of the plate cylinder from the impression cylinder). That is, a different printed area 400 including a different set of low transfer distance points, is associated with each cylinder of the printing press for determining an inclination angle for each cylinder separately.

Figure 4B:
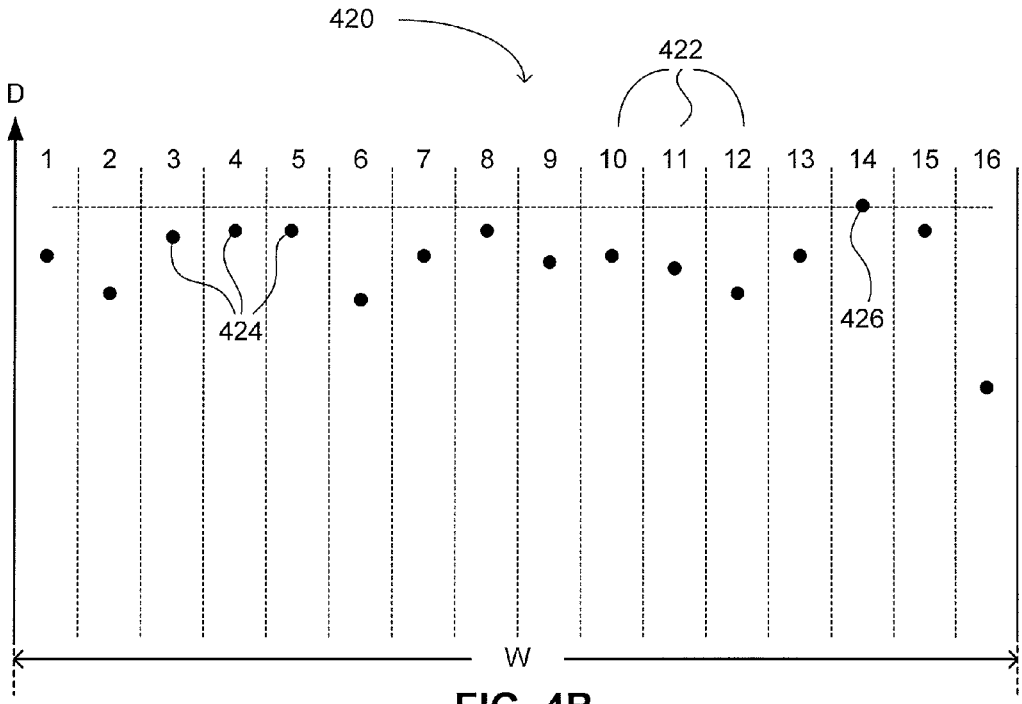
FIG. 4B is a schematic illustration of a printed area, including a set of high transfer distance points, constructed in accordance with another embodiment of the disclosed technique.

Reference is now made to FIG. 4B, which is a schematic illustration of a printed area, generally referenced 420, including a set of high transfer distance points, constructed in accordance with another embodiment of the disclosed technique. Printed area 420, having a width W, is divided into 16 vertical segments 422. Each vertical segment 422 includes a high transfer distance point 424 corresponding to a high transfer distance as determined by the respective ink transfer graph (e.g., ink transfer graph 250 of FIG. 2F).

A minimal high distance point 426, corresponding to the minimal high transfer distance value, is determined from at least a portion of the set of high transfer distance points 424. The minimal high distance is employed (i.e., together with the inclination angle of straight line 406 of FIG. 4A) for determining the printing distance line, as detailed herein below with reference to FIG. 4C. It is reminded that the high transfer distances, and printed area 420 including high transfer distance points 424, are associated with a selected cylinder of the printing press. As mentioned above, with reference to FIG. 2D, the distances are indicated in negative values and therefore, minimal high distance point 426 is the highest distance point in graph 420, associated with the minimal distance.

Alternatively, the set of high transfer distance points 424 can further by employed for producing straight line 406 (FIG. 4A) and determining its inclination angle, as detailed herein above with reference to FIG. 4A. Further alternatively, the inclination angle of straight line 406 is determined separately according to the set of low transfer distance points and according to the set of high transfer distance points and the inclination angle is determined from a combination of both angles (e.g., the inclination angle is set as the minimum angle, or by a weighted mean of the angles).

Figure 4C:
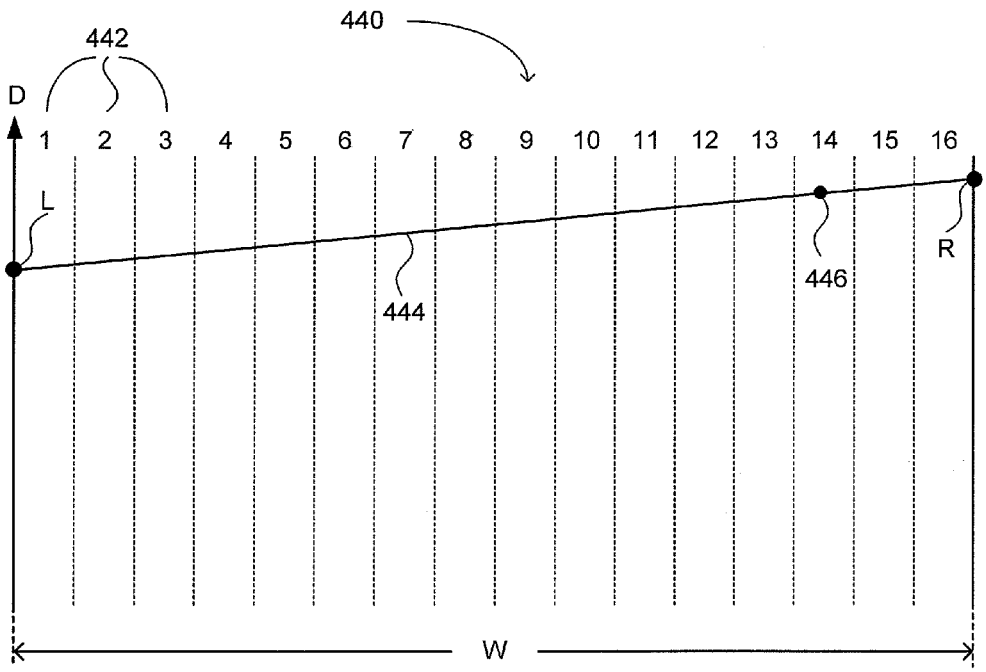
FIG. 4C is schematic illustration of a printed area, including a distance-to-print line, constructed and operative in accordance with a further embodiment of the disclosed technique.

Reference is now made to FIG. 4C, which is schematic illustration of a printed area, generally referenced 440, including a printing distance line, constructed and operative in accordance with a further embodiment of the disclosed technique. Printed area 440, having a width W, is divided into 16 vertical segments 442. Distance-to-print line 444 goes through a minimal high distance point 446, which is determined according to a set of high transfer distance points as detailed herein above with reference to FIG. 4B. The inclination angle (i.e., the angle) of distance-to-print line 444 is set as the inclination angle of fitted straight line 406, which is determined according to a set of low transfer distance points as detailed herein above with reference to FIG. 4A.

Distance-to-print line 444 is employed for determining the left side print distance L and the right side print distance R of the selected cylinder. The left side print distance L is determined according to a point L positioned at the intersection of Side print distance line 444 and the left end of printed area 440. The right side print distance R is determined according to a point R positioned at the intersection of Side print distance line 444 and the right end of printed area 440.

Alternatively, the fitted curve, replacing straight line 406 is a two dimensional curve fitted to the set of low transfer distance points (e.g., low transfer distance points 404 of FIG. 4A), and shifted to go through the minimal high distance point. The left side print distance L and the right side print distance R are determined according to the intersection of the fitted curve with the ends of printed area. In case the fitted curve is not a straight line, the left side print distance L and the right side print distance R are employed for determining the inclination angle of distance-to-print line 444. The inclination angle of distance-to-print line 444 is set as the inclination angle of the line (not shown) going through the left side print distance L and through the right side print distance R.

The left and the right side print distances L and R are employed for determining a left actuator working distance and a right actuator working distance for the left actuator and the right actuator, respectively, of the selected cylinder, as detailed herein above with reference to FIGS. 3A and 3B.

Figure 5:
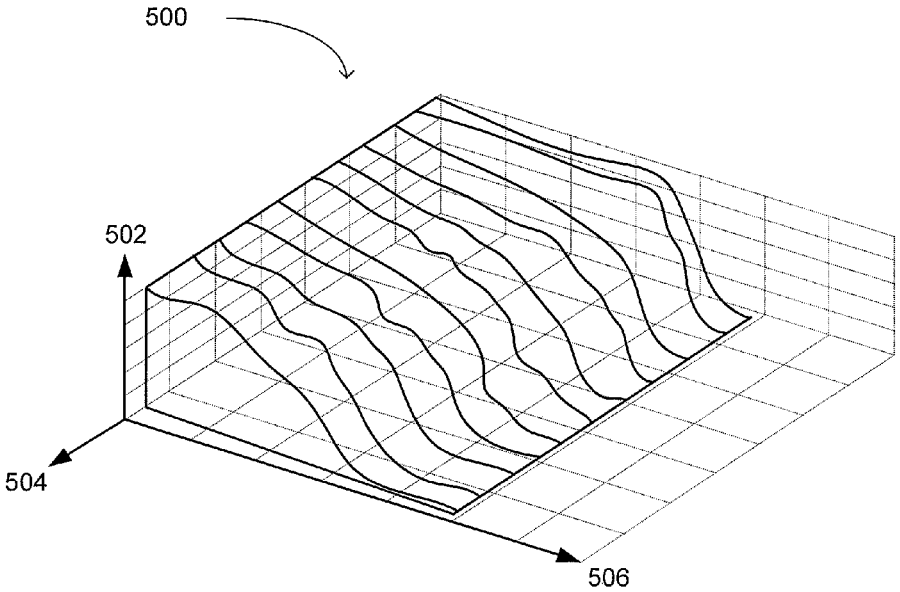
FIG. 5 is a schematic illustration of a three dimensional ink transfer graph, constructed and operative in accordance with another embodiment of the disclosed technique.

The left and the right side print distances L and R can further be determined according to a three dimensional graph combining the set of the ink transfer graphs (e.g., ink transfer graph 250 of FIG. 2F). Reference is now made to FIG. 5, which is a schematic illustration of a three dimensional ink transfer graph, generally referenced 500, constructed and operative in accordance with another embodiment of the disclosed technique. Three dimensional ink transfer graph 500 (i.e., 3D graph 500) is constructed by combining the set of the two dimensional ink transfer graphs, such that the added third dimension is the vertical segment dimension. That is, 3D graph 500 depicts the ink transfer versus the relative distance and versus the vertical segment. As mentioned above, with reference to FIGS. 2D-2F, a separate set of ink transfer graphs is produced for each of the anilox cylinder and the plate cylinder. Therefore, a separate 3D graph is produced for each of the cylinders. The 3D graph for the anilox cylinder is produced according to the portion of the ink transfer graphs which relates to the displacement of the anilox cylinder toward the plate cylinder, as detailed in FIG. 1B. The 3D graph for the plate cylinder is produced according to the portion of the ink transfer graphs which relates to the displacement of the plate cylinder (with the anilox cylinder) away from the impression cylinder, as detailed in FIG. 1C.

Axis 502 represents the ink transfer, axis 504 represents the vertical segment and axis 506 represents the relative distance. Alternatively, axis 502 can represent ink transfer percentage, axis 504 can represent a sensor, or a group of sensors, of the camera employed for acquiring the images of the printed area, and axis 506 can represent the distance of the respective cylinder.

A 3D function is fitted to 3D graph 500 (i.e., to the measured points of 3D graph 500) for determining the left and the right side print distances L and R. For example the 3D function is a hyperbolic tangent extended in the direction of axis 504. The left side print distance L and the right side print distance R are extracted from the 3D function, as detailed herein.

For example, the fitted 3D function is given by:

$$\text{Ink}=(k1+k2*\tan h(k3+k4*d)*(k5*d+k6)*(k7*x+k8) \quad (5)$$

Where 'x' is a respective sensor of the camera; 'd' is the cylinder distance (i.e., either from the web or from another cylinder, depending on the selected cylinder); 'Ink' is the ink transfer magnitude; and k is a set of parameters. Each of the set of parameters k, is determined by the fitting of the 3D function. For example, the 3D function is fitted such that the sum of all distance of points from the 3D function is minimal. Once the set of parameters k, is determined, 'd' can be extracted from equation (5) for each value of 'x', and of 'Ink'. Thereby, the left side print distance L and the right side print distance R are extracted.

Another way of determining the left and the right side print distances L and R is to divide the printed area into a number of vertical segments, for example 2. The acquired images are analyzed for determining the distance at which the first print defect appears in each of the two segments of the printed area. That is the distance at which the printed image exhibits a single print defect due to lack of ink coverage (i.e., ink transfer), and is thus set as the side print distance for the respective segment (i.e., either the left side print distance L or the right side print distance R).

Figure 6:
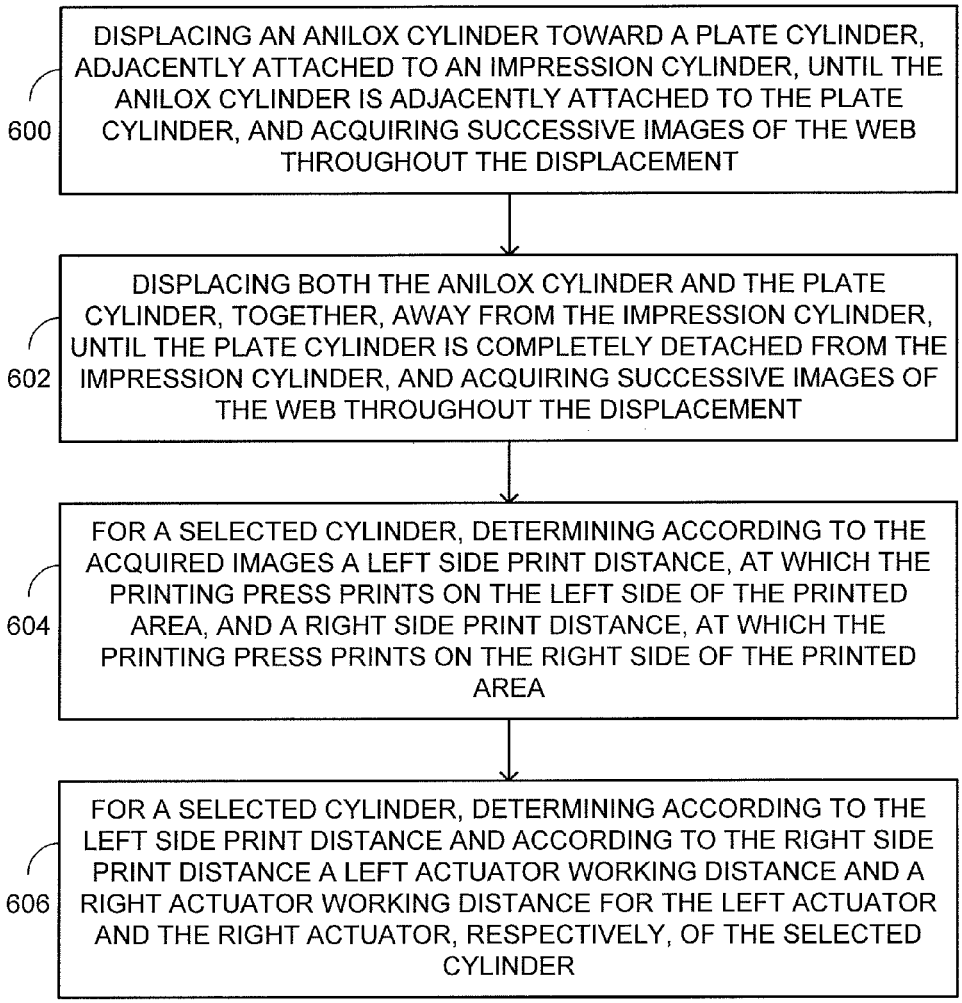
FIG. 6 is a schematic illustration of a method for setting the pressure of the cylinders of a printing station, operative in accordance with a further embodiment of the disclosed technique.

Reference is now made to FIG. 6, which is a schematic illustration of a method for setting the pressure of the cylinders of a printing station, operative in accordance with a further embodiment of the disclosed technique. In procedure 600, an anilox cylinder is displaced toward a plate cylinder, adjacently attached to an impression cylinder, until the anilox cylinder is adjacently attached to the plate cylinder, and successive images of the web are acquired throughout the displacement. With reference to FIGS. 2A-2C, actuators 208 displace anilox cylinder 202 toward plate cylinder 204 until anilox cylinder 202 is adjacently attached to plate cylinder 204. The camera acquires images of the printed area on web 210 throughout the displacement of anilox cylinder 202.

In procedure 602, both the anilox cylinder and the plate cylinder are displaced, in unison, away from the impression cylinder, until the plate cylinder is completely detached from the impression cylinder, and successive images of the web are acquired throughout the displacement. With reference to FIGS. 2A-2C, actuators 208 displace both anilox cylinder 202 and plate cylinder 204 away from impression cylinder 206 until plate cylinder 204 is fully detached from web 210 and from impression cylinder 206. The camera acquires images of the printed area on web 210 throughout the displacement of anilox cylinder 202 and of plate cylinder 204.

Alternatively, in case the printing press includes only a single cylinder (i.e., only the plate cylinder) besides the impression cylinder, procedure 600 involves displacing the plate cylinder toward the impression cylinder until the plate cylinder is adjacently attached to the impression cylinder. Procedure 602 involves displacing the plate cylinder away from the impression cylinder until the cylinders are fully detached. The images acquired during the displacements of the plate cylinder are employed for producing a set of ink transfer graphs, as detailed herein above. Further alternatively, in case the printing press includes only a single cylinder (i.e., only the plate cylinder) besides the impression cylinder, procedure 600 involves displacing the plate cylinder toward the impression cylinder until the plate cylinder is adjacently attached to the impression cylinder. Procedure 602 is omitted from the method. The images acquired during the displacements of the plate cylinder are employed for producing a set of ink transfer graphs, as detailed herein above.

In procedure 604, for a selected cylinder, a left side print distance and a right side print distance are determining according to the acquired images. The left side print distance is defined as the distance, at which the printing press prints on the left side of the printed area, at a predetermined sufficient print quality. The right side print distance is defined as the distance, at which the printing press prints on the right side of the printed area, at a predetermined sufficient print quality. With reference to FIGS. 2D-2F, ink transfer paragraph 250 is produced for each vertical segment of the printed area. With reference to FIGS. 4A-4C, the set of low distance transfer points 404 and the set of high transfer distance points 424 are determined according to the set of ink transfer graphs 250. Left side print distance L and right side print distance R are determined according to a curve fitted to the set of low distance transfer points 404 and shifted to pass through a minimal one of the set high transfer distance points 424 (e.g., thereby defining distance-to-print line 444). Alternatively, with reference to FIG. 5, three dimensional ink transfer graph 500 is determined according to the set of ink transfer graphs 250. A 3D function is fitted to 3D graph 500 for determining the left and the right side print distances L and R.

In procedure 606, for a selected cylinder, a left actuator working distance and a right actuator working distance for the left actuator and the right actuator, respectively, of the selected cylinder are determined according to the left side print distance and according to the right side print distance. The left and right actuator working distances are determined and set for printing the printed image on the web at a predetermined sufficient print quality and with minimum ink usage (i.e., minimum ink waste). That is, the pressure between the different cylinders of the printing station, and between the cylinders and the web, is set such that on the one hand the printed image is printed without defects, and on the other hand, the printed image is printed with the minimal amount of ink.

With reference to FIG. 3A, left actuator working distance 318 and right actuator working distance 320 are determined according to the left side print distance and according to the right side print distance. In particular, left actuator working distance 318 is defined by either of equations (1) or (2). Right actuator working distance 320 is defined by either of equations (3) or (4). Wherein $\alpha$ being the inclination angle of cylinder $\mathbf{302}_L$ with respect to web 306, and wherein $\mathrm{Sin}(\alpha)$ is given by (D/W).

It will be appreciated by persons skilled in the art that the disclosed technique is not limited to what has been particularly shown and described hereinabove. Rather the scope of the disclosed technique is defined only by the claims, which follow.

The invention claimed is:

1. A method for setting the pressure of a printing station, including at least one cylinder, of a printing press, from acquired images of printed areas of the printed web, the method comprising the procedures of:

displacing said at least one cylinder of said printing station in accordance with a pre-defined displacement scheme comprising a plurality of displacements; for each displacement in said pre-defined displacement scheme, acquiring a respective image of a respective one of said printed areas;

after acquiring at least a plurality of images of said printed areas respective of a plurality of said displacements of said pre-defined displacement scheme, determining for each of said at least one cylinder, a left side print distance and a right side print distance, at which said printing station prints, at a predetermined sufficient print quality, according to a plurality of said of said at least a plurality of said acquired images of said printed areas respective of different displacements of said displacements of said pre-defined displacement scheme; and determining for said each of said at least one cylinder a left actuator working distance and a right actuator working distance for the left actuator and the right actuator, respectively, of said each of said at least one cylinder, according to said left side print distance and according to said right side print distance.

2. The method of claim 1, wherein said at least one cylinder includes an anilox cylinder and a plate cylinder of said print station, and wherein at an initial configuration of said predefined displacement scheme said plate cylinder being positioned adjacent to said impression cylinder, and said anilox cylinder being positioned at an initial distance from said plate cylinder and said impression cylinder, said predefined displacement scheme involving moving said anilox cylinder toward said plate cylinder until said anilox cylinder being positioned adjacent to said plate cylinder and then moving both said anilox cylinder and said plate cylinder together away from said impression cylinder.

3. The method of claim 1, wherein said procedure of determining said left side print distance and said right side print distance including dividing said printed area into N segments, and determining for each selected one of said N segments ink transfer percentage in each of said acquired images.

4. The method of claim 3, wherein ink transfer percentage is defined by comparing ink transfer magnitude of said selected one of said N segments with ink transfer magnitude of a respective segment of a predefined reference image, for each of said acquired images, and wherein ink transfer magnitude is defined by the sum of the distances, in a color space, of each of the pixels in said selected one of said N segment from a reference background pixel of an unprinted area of the web.

5. The method of claim 3, further including producing a set of ink transfer graphs by producing for each selected one of said N segments an ink transfer graph detailing ink transfer percentage in each of said acquired images.

6. The method of claim 5, wherein said left side print distance and said right side print distance being defined by the intersections of a distance-to-print curve with a left and a right boundaries, respectively, of said printed area, wherein said distance-to-print curve being determined according to said set of ink transfer graphs.

7. The method of claim 6, wherein said distance-to-print curve being determined by fitting a curve to a set of low distance points, and shifting said curve such that it goes through a minimal one of a set of high distance points, said set of low distance points and said set of high distance points being determined according to said set of ink transfer graphs such that a low distance point indicates the position of said cylinder at which said print station prints at a low ink transfer percentage onto a respective one of said N segments and a high distance point indicates the position of said cylinder at which said print station prints at a high ink transfer percentage onto said respective one of said N segments.

8. The method of claim 5, wherein said left side print distance and said right side print distance being extracted from a curve fitted to a three dimensional graph produced by combining said set of ink transfer graphs.

9. The method of claim 1, wherein said left actuator working distance being determined by the following equation (1):

$$\text{(Left actuator working distance)}=\text{(left side print distance)}-X*\text{Sin}(\alpha) \quad (1)$$

and wherein said right actuator working distance being determined by the following equation (2):

$$\text{(Right actuator working distance)}=\text{(Right side print distance)}+[X+W]*\text{Sin}(\alpha) \quad (2)$$

wherein 'Sin(α)' being (D/W), 'D' being the difference between said left side print distance and said right side print distance, 'W' being the width of said printed area, and 'X' being the length of said cylinder extending beyond one of the ends of said printed area.

10. The method of claim 1, wherein said left actuator working distance being determined by the following equation (3):

$$\text{(Left actuator working distance)}=\text{(left side print distance)}-[X+W]*\text{Sin}(\alpha) \quad (3)$$

and wherein said right actuator working distance being determined by the following equation (4):

$$\text{(Right actuator working distance)}=\text{(Right side print distance)}+X*\text{Sin}(\alpha) \quad (4)$$

wherein 'Sin(α)' being (D/W), 'D' being the difference between said left side print distance and said right side print distance, 'W' being the width of said printed area, and 'X' being the length of said cylinder extending beyond one of the ends of said printed area.

11. A system for setting the pressure of a printing station, including at least one cylinder, of a printing press, from acquired images of printed areas of the printed web, the system comprising:

an imaging device for acquiring a respective image of a respective one of said printed areas for each displacement in a pre-defined displacement scheme of said at least one cylinder; said pre-defined displacement scheme comprising a plurality of displacements; and a processor coupled with said imaging device and with actuators of each of said at least one cylinder, said processor instructing the actuators of said each of said at least one cylinder to perform said pre-defined displacement scheme, said processor receiving said acquired images of said printed areas from said imaging device, after acquiring at a least a plurality of said images of said printed areas respective of a plurality of said displacements of said pre-defined displacement scheme, said processor determining a left side print distance of said cylinder, and a right side print distance of said cylinder, at which said printing station prints, at a predetermined sufficient print quality, according to a plurality of said at least a plurality of said acquired images of said printed areas respective of different ones of said displacements of said plurality of said pre-defined displacement scheme.

12. The system according to claim 11, wherein said at least one cylinder includes an anilox cylinder and a plate cylinder of said print station, and wherein at an initial configuration of said predefined displacement scheme said plate cylinder being positioned adjacent to said impression cylinder, and said anilox cylinder being positioned at an initial distance from said plate cylinder and said impression cylinder, said predefined displacement scheme involving moving said anilox cylinder toward said plate cylinder until said anilox cylinder being positioned adjacent to said plate cylinder and then moving both said anilox cylinder and said plate cylinder together away from said impression cylinder.

13. The system according to claim 11, wherein said processor determining said left side print distance and said right side print distance by dividing said printed area in each of said acquired images into N segments, and producing for each selected one of said N segments an ink transfer graph detailing ink transfer percentage in said acquired images, wherein ink transfer percentage is defined by comparing ink transfer magnitude of said selected one of said N segments with ink transfer magnitude of a respective segment of a predefined reference image, for each of said acquired images, and wherein ink transfer magnitude being defined by the sum of the distances, in a color space, of each of the pixels in said selected one of said N segment from a reference background pixel of an unprinted area of the web.

14. The system according to claim 11, wherein said processor determines said left actuator working distance by the following equation (1):

$$\text{(Left actuator working distance)}=\text{(left side print distance)}-X*\text{Sin}(\alpha) \quad (1)$$

and wherein said processor determines said right actuator working distance by the following equation (2):

$$\text{(Right actuator working distance)}=\text{(Right side print distance)}+[X+W]*\text{Sin}(\alpha) \quad (2)$$

wherein 'Sin(α)' being (D/W), 'D' being the difference between said left side print distance and said right side print distance, 'W' being the width of said printed area, and 'X' being the length of said cylinder extending beyond one of the ends of said printed area.

15. The system according to claim 11, wherein said processor determines said left actuator working distance by the following equation (3):

$$\text{(Left actuator working distance)}=\text{(left side print distance)}-[X+W]*\text{Sin}(\alpha) \quad (3)$$

and wherein said processor determines said right actuator working distance by the following equation (4):

$$\text{(Right actuator working distance)}=\text{(Right side print distance)}+X*\text{Sin}(\alpha) \quad (4)$$

wherein 'Sin(α)' being (D/W), 'D' being the difference between said left side print distance and said right side print distance, 'W' being the width of said printed area, and 'X' being the length of said cylinder extending beyond one of the ends of said printed area.

* * * * *